US008875444B2

(12) United States Patent
Dunn

(10) Patent No.: US 8,875,444 B2
(45) Date of Patent: Nov. 4, 2014

(54) METHOD OF INSTALLING A LOW-PROFILE THRESHOLD BARRIER

(71) Applicant: Munchkin, Inc., Van Nuys, CA (US)

(72) Inventor: Steven Bryan Dunn, Beverly Hills, CA (US)

(73) Assignee: Munchkin, Inc., Van Nuys, CA (US)

( * ) Notice: Subject to any disclaimer, the term of this patent is extended or adjusted under 35 U.S.C. 154(b) by 0 days.

(21) Appl. No.: 14/091,286

(22) Filed: Nov. 26, 2013

(65) Prior Publication Data

US 2014/0083014 A1 Mar. 27, 2014

Related U.S. Application Data

(63) Continuation of application No. 13/303,091, filed on Nov. 22, 2011, now Pat. No. 8,615,931.

(51) Int. Cl.

| | |
|---|---|
| ***E06B 3/00*** | (2006.01) |
| ***E06B 3/36*** | (2006.01) |
| ***E06B 9/04*** | (2006.01) |
| ***E06B 9/02*** | (2006.01) |
| ***E05B 1/00*** | (2006.01) |
| ***E06B 1/52*** | (2006.01) |
| *E06B 9/00* | (2006.01) |

(52) U.S. Cl.

CPC ... *E06B 3/36* (2013.01); *E06B 9/04* (2013.01); *E06B 9/02* (2013.01); *E05B 1/00* (2013.01); *E06B 1/52* (2013.01); *E06B 2009/002* (2013.01)

USPC ..... 49/506; 49/465; 160/215

(58) Field of Classification Search

CPC ..... E06B 9/04

USPC ..... 49/50, 57, 55, 463, 465, 506; 160/180, 160/215, 405

See application file for complete search history.

(56) References Cited

U.S. PATENT DOCUMENTS

| | | | | |
|---|---|---|---|---|
| 5,657,809 | A | 8/1997 | Longoria et al. | |
| 5,906,069 | A | 5/1999 | Berliner | |
| 5,924,242 | A | 7/1999 | Macari et al. | |
| 7,422,048 | B2 | 9/2008 | Andersen | |
| 7,658,220 | B2 | 2/2010 | Yates | |
| 8,297,336 | B2 | 10/2012 | Yates | |
| 2003/0005643 | A1 * | 1/2003 | Yang | 49/463 |
| 2003/0110704 | A1 | 6/2003 | Cheng | |
| 2005/0028947 | A1 | 2/2005 | Waldman et al. | |
| 2008/0236045 | A1 | 10/2008 | Deblonk et al. | |
| 2009/0158666 | A1 | 6/2009 | Atkinson et al. | |
| 2009/0293363 | A1 | 12/2009 | Flannery | |
| 2012/0211182 | A1 | 8/2012 | Pilgrim et al. | |

OTHER PUBLICATIONS

International Search Report and Written Opinion for PCT/IB11/02886, Nov. 30, 2011.

* cited by examiner

*Primary Examiner* — Katherine Mitchell
*Assistant Examiner* — Scott Denion
(74) *Attorney, Agent, or Firm* — Robert Z. Evora, Esq.; Wade C. Yamazaki

(57) ABSTRACT

A low-profile barrier and method of installation is provided including a barrier door located in an opening defined by a frame having a pair of upwardly extending arms connected to a lower cross member. In an un-installed position, the lower cross member has a curvature biasing the upwardly extending arms outward. In an installed position, the curvature of the lower cross member is compressed to zero so that the lower cross member lays flat against a lower surface.

20 Claims, 10 Drawing Sheets

FIG. 5
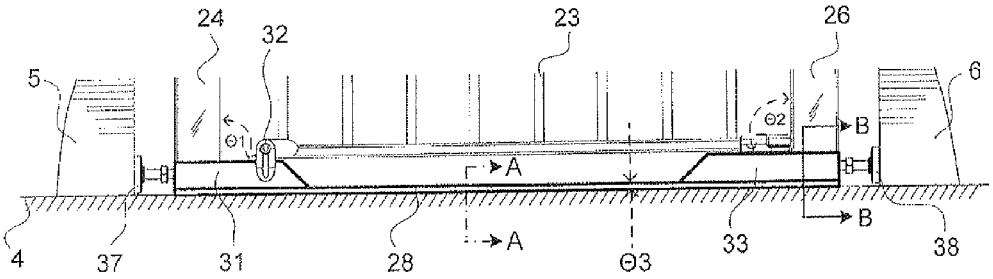
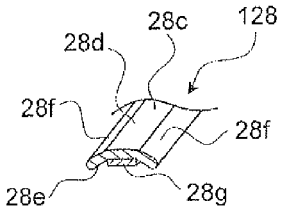
FIG. 6A
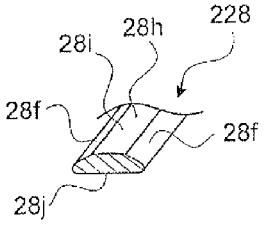
FIG. 6B
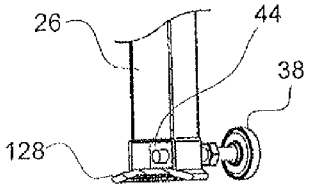
FIG. 7A
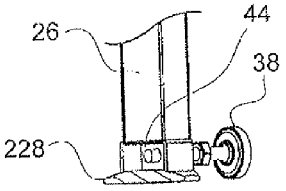
FIG. 7B

METHOD OF INSTALLING A LOW-PROFILE THRESHOLD BARRIER

CROSS REFERENCE TO RELATED APPLICATION

This application claims priority to U.S. patent application Ser. No. 13/303,091, filed Nov. 22, 2011; the contents of which are hereby incorporated by reference herein in their entirety into this disclosure.

TECHNICAL FIELD

The subject disclosure relates to a barrier assembly and particularly to a safety gate assembly having an unobtrusive low-profile threshold cross member that eliminates dangerous tripping hazards.

BACKGROUND

U-shaped frame gate assemblies are particularly popular in homes to block off an area for a child and/or pet. They are quick to install and can be secured without having to install unsightly permanent hardware into the opening of a doorframe causing unnecessary damage to the doorframe.

However, the problem with conventional U-shaped gate assemblies is that they introduce the unsafe potential for a passerby to trip as they walk through the gate. That is, the lower frame member of the gate assembly that extends across the threshold of a doorway is obtrusive and inconspicuously projects upward from the floor causing a dangerous hazard to persons passing through the open gate. The same problem is exacerbated when a U-shape gate assembly is installed at the top of a stairway, thereby increasing the chances of a terrible accident.

By way of conventional illustration, FIGS. 12 and 13 show a conventional safety gate 150 for use in a doorframe. The frame 110 of the conventional gate 150 is substantially U-shaped and includes a pair of upwardly extending arms 112, 114 attached to a lower cross member 116. A gate panel 118 is pivotally attached at one end to the arm 114. FIG. 12 shows the conventional gate 150 in a pre-installed state in which the lower cross member 116 is a large inflexible frame member. In this state, both of the arms 112, 114 extend away from the lower cross member 116 at a slight outward angle in directions 120 and 121, respectively.

As shown installed in a doorframe 120 in FIG. 13, the slight angle in the arms 112, 114 is compressed and provides an opposing spring force to wedge the gate 150 within the doorframe 120. A force is provided to bend the arms 112, 114 inward such that they extend perpendicular from the inflexible lower cross member 116. The securing force is a friction force that secures the conventional gate 150 in the doorframe 120 and prevents children and/or animals from exiting through the conventional gate 150.

As shown in FIGS. 12 and 13, the lower cross member 116 is purposely designed to be rigid and inflexible so that it does not bend during installation. In order to provide a lower cross member 116 that is sufficiently rigid to withstand any bending and/or significant deformation during installation, the lower cross member 116 has conventionally been designed to be quite large and bulky. The conventional height of the lower cross member 116 in the industry extends upward typically in a range between 1⅛ inches to 2 inches. This height in most instances is larger than the height of a toe of a barefoot person, and in many instances larger than the toe portion of a person wearing a shoe. Unfortunately, the conventionally large lower cross member 116 across the threshold of the doorframe 120 obtrusively projects from the floor unsafely causing the dangerous tripping hazard.

Although various solutions have been proposed, none available has effectively solved this dangerous problem.

SUMMARY

The following presents a simplified summary of the subject disclosure in order to provide a basic understanding of some aspects thereof. This summary is not an extensive overview of the various embodiments of the subject disclosure. It is intended to neither identify key or critical elements of the subject disclosure nor delineate any scope thereof. The sole purpose of the subject summary is to present some concepts in a simplified form as a prelude to the more detailed description that is presented hereinafter.

One or more embodiments of the subject disclosure provide for a low-profile barrier assembly and method of installation. The low-profile barrier provides a barrier door located in an opening defined by a frame having a pair of upright frame members connected to a lower cross member. In an un-installed position, the lower cross member has a curvature biasing the upwardly extending arms outward. In an installed position, the curvature of the lower cross member is compressed to zero so that the lower cross member lays flat against a lower surface While various aspects, features, or advantages of the subject disclosure are illustrated in reference to safety gates, such aspects and features also can be exploited in various other barrier configurations.

To the accomplishment of the foregoing and related ends, the subject disclosure, then, comprises the features hereinafter fully described. The following description and the annexed drawings set forth in detail certain illustrative aspects of one or more embodiments of the disclosure. However, these aspects are indicative of but a few of the various ways in which the principles of the subject disclosure may be employed. Other aspects, advantages and novel features of the subject disclosure will become apparent from the following detailed description of various example embodiments of the subject disclosure when considered in conjunction with the drawings.

BRIEF DESCRIPTION OF DRAWINGS

FIG. 5 shows an exploded view of the low-profile barrier assembly compressed within the doorframe in accordance with aspects described herein.

FIG. 6A illustrates an example cross section view of the threshold member about A-A in FIG. 5 in accordance with aspects described herein.

FIG. 6B shows a cross section view of another exemplary threshold member about A-A in FIG. 5 in accordance with aspects described herein.

FIG. 7A depicts an example cross section view of the threshold member in FIG. 6A and the upright support about B-B in FIG. 5 in accordance with aspects described herein.

FIG. 7B illustrates a cross section view of another exemplary threshold member in FIG. 6B and the upright support about B-B in FIG. 5 in accordance with aspects described herein.

DETAILED DESCRIPTION

Figure 1:
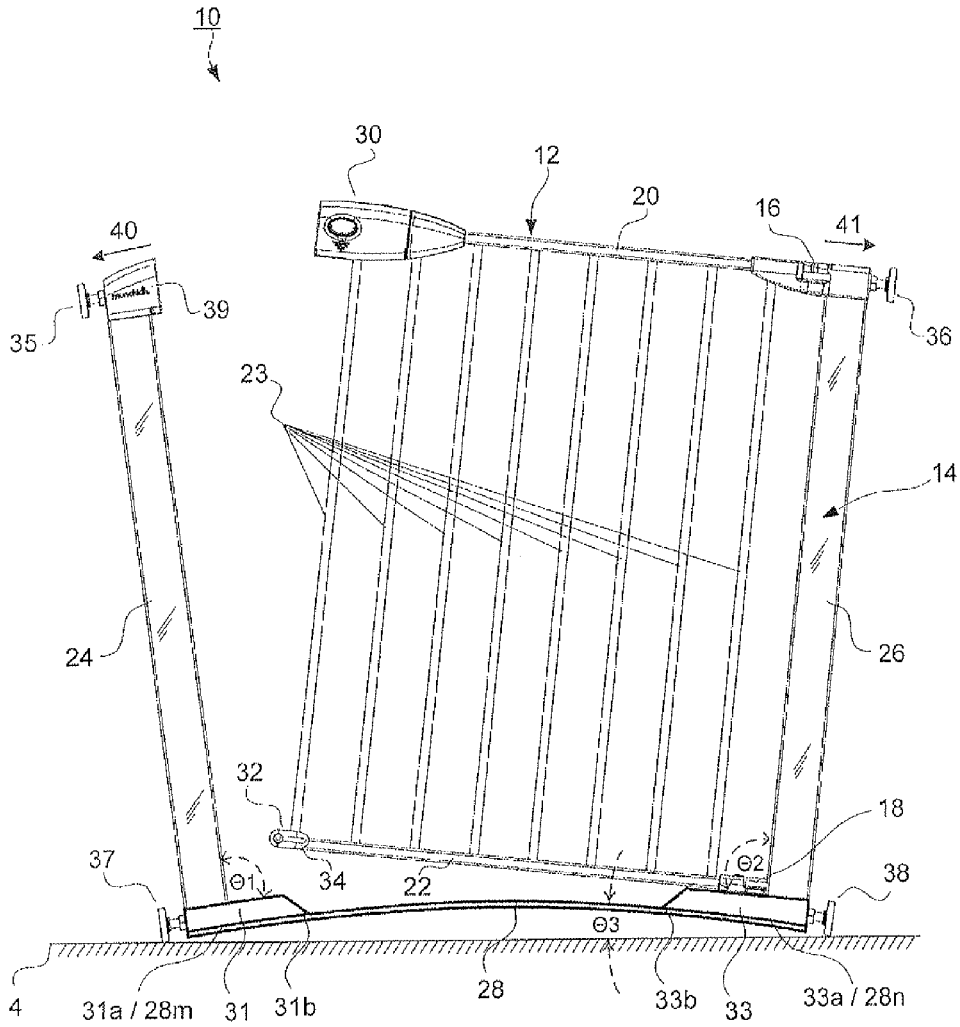
FIG. 1 illustrates an exemplary gate assembly having a low-profile threshold in accordance with aspects described herein.

The subject disclosure is described with reference to the drawings, wherein like reference numerals are used to refer to like elements throughout. In the following description, for purposes of explanation, numerous specific details are set forth in order to provide a thorough understanding of the present disclosure. It may be evident, however, that the present disclosure may be practiced without these specific details.

Figure 2:
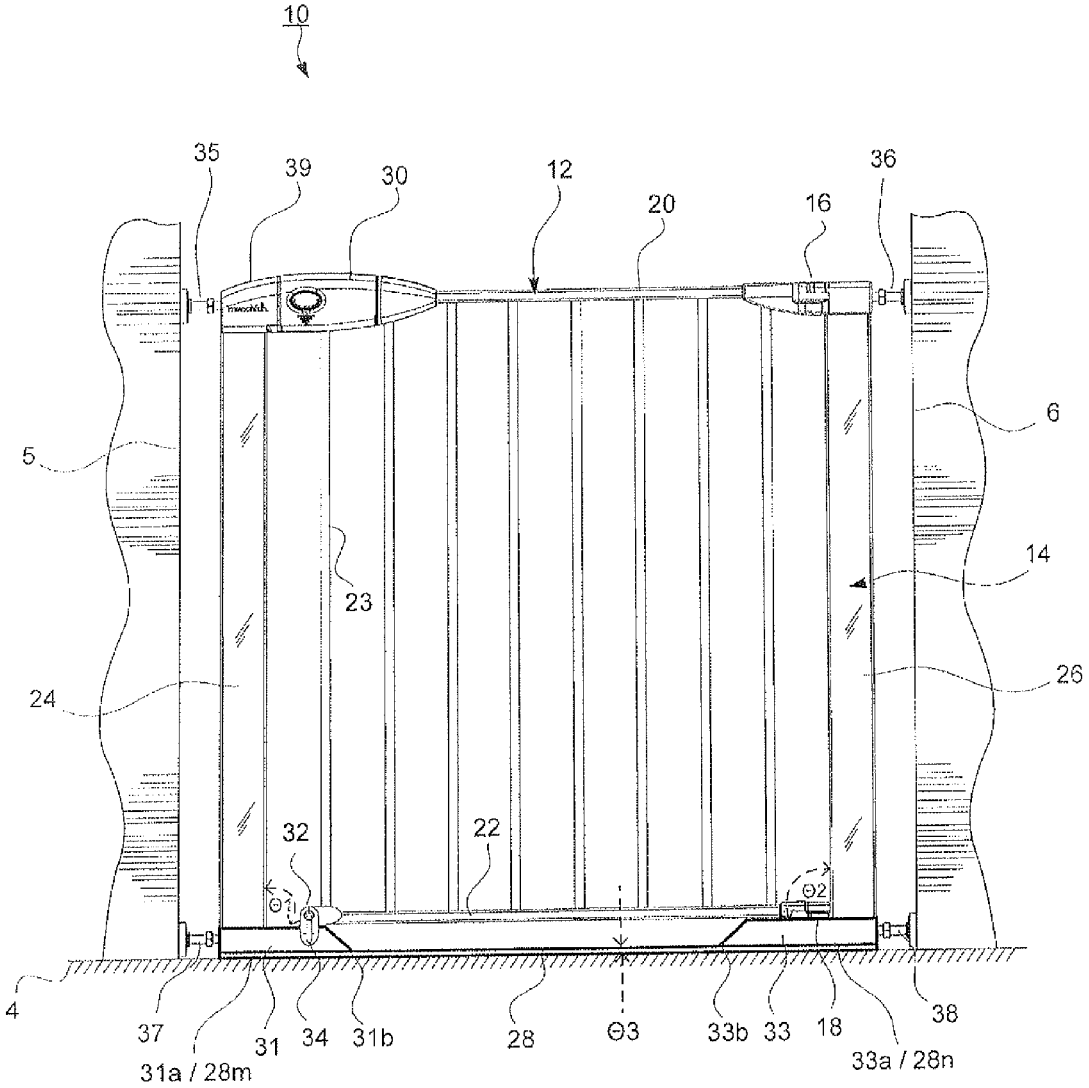
FIG. 2 depicts the example low-profile barrier assembly fully compressed and secured within the doorframe in accordance with aspects described herein.

FIG. 1 illustrates the exemplary low-profile barrier 10 in an uninstalled position, and FIG. 2 shows the exemplary low-profile barrier 10 in an installed position within opposing surfaces 5, 6. The low-profile barrier 10 includes a barrier door 12 pivotally attached to a frame 14.

The barrier door 12 includes at least an upper barrier member 20 and a lower barrier member 22 connected to each other by a plurality of vertical barrier members 23. The plurality of vertical barrier members 23 may be selected from a width that is sized and shaped to substantially fill a passageway obstructed by the low-profile barrier 10.

The barrier door 12 is pivotally attached to the frame 14 by an upper hinge 16 and a lower hinge 18 and pivots along a pivot axis. That is, the door 12 pivots relative to the frame 14 on an upper hinge 16, and a lower hinge 18, from a closed position (as show in FIG. 2) to an open position (not shown). The top of the upright frame member 26 may be adapted to receive the upper hinge 16, and the bottom of the upright frame member 26 may be adapted to receive the lower hinge 18. As such, the barrier door 12 is capable of pivoting about the pivot axis through the hinges 16, 18 lying in a plane adjacent to the upright frame member 26.

The frame 14 of the low-profile barrier 10 is substantially U-shaped and includes a pair of upright frame members 24, 26, or arms, connected to a pair of gussets 31, 33, respectively, which in turn are connected to a lower cross member 28. As shown in the uninstalled position of FIG. 1, both of the upright frame members 24, 26 are connected to the gussets 31, 33 and extend away from the lower cross member 28 at predetermined outward angles θ1, θ2 from each other.

The upright frame members 24, 26 extend away from the lower cross member 28, and outward, away from each other in directions 40 and 41. Angles θ1, θ2 between upright frame members 24, 26 and gusset member 31, 33 respectively, may be independently oriented at 90-degrees and/or greater than 90 degrees, such as in the range between approximately 90 to 150 degrees. The angular ranges θ1, θ2 may vary since the first upright frame member 24 may not be biased by the weight of the barrier door 12. Thus, the first upright frame member 24 may be aligned at an angle θ1 different from the angle θ2 of the second upright frame member 26 that is bearing the weight of the barrier door 12 and would be compensated therefore.

During installation of the low-profile barrier 10 into an opening area defined by two opposing surfaces 5, 6, an opposing resultant force is required to overcome a first spring biased force directed outward and provided by the outwardly angled upright frame members 24, 26. As discussed briefly above, and in more detail below, the range of the outward angles θ1, θ2 is determined based on a plurality of different independent factors. The resultant force is gradually applied to the upright frame members 24, 26 inward against the outwardly applied spring bias force of the upright frame members 24, 26 until they are positioned to extend substantially perpendicular to the lower cross member 28 and substantially parallel to the opposing surfaces 5, 6.

The gradual inward resultant force may be applied by adjustable fasteners 35, 36, 37, 38 and/or any other suitable fastener capable of performing the functions of the subject disclosure. In use, the adjustable fasteners 35, 36, 37, 38 grab onto and apply a sturdy friction fit against the opposing surfaces 5, 6 as the adjustable fasteners 35, 36, 37, 38 are adjusted outward in an axial helical motion.

As shown in FIG. 2, the predetermined resultant force selected is one that is strong enough to secure the barrier door 12 between the opposing surfaces 5, 6 and allow the barrier door 12 to operate to allow egress and ingress across the low-profile barrier 10. Further, the predetermined resultant force, and the counteracting outwardly biased force are sufficiently strong enough to prevent animals, small children, and the like from overcoming the friction fit produced between the adjustable fasteners 35, 36, 37, 38 and the opposing surface 5, 6.

A locking handle 30 provided with a latching mechanism (not shown) may be mounted to the upper barrier member 20 on an end opposite the upper hinge 16. A mating catch mechanism 39, or retainer, including a catch (not shown) may be disposed at the upper end of the upright frame member 24 in alignment with the locking handle 30. The catch mechanism 39 is adapted to mate, and interlock with the latching mechanism of the locking handle 30. Locking and unlocking of the latching mechanism to allow egress and ingress through the low-profile barrier 10 may be performed in a number of different ways, such as by movement of the locking handle 30 to allow the barrier door 12 to be moved between an open and closed position.

An optional latch 32 may be fastened to the bottom of the barrier door 12, such as on the lower barrier member 22 in order to latch the lower part of barrier door 12 to the lower cross member 28 or other fixed location on the frame 12. In one exemplary embodiment, the latch 32 may include a latching arm 34 that is pivotally movable between a latched and unlatched position. In the unlatched position, the latching arm 34 is spaced a distance apart from the lower cross member 28 (such as in a horizontal position) as shown in FIG. 1. In a latched position, the latching arm 34 is pivotally moved into engagement against the lower cross member 28 (such as in a vertical position) as shown in FIG. 2.

In the uninstalled rest position shown in FIG. 1, the lower cross member 28 is constructed to include a predetermined curvature θ3. During installation, the predetermined curvature θ3 is gradually flattened out and a second spring bias force inert in the plasticity of the curvature gradually increases as the adjustable fasteners 35, 36, 7, 38 bias the upright frame members 26, 28 outward against the opposing surface 5, 6. The second spring bias force is at maximum as shown in FIG. 2, when the curvature is completely flat and the lower cross member lies flush with the lower surface 4. This force also contributes to the overall friction force that secures the low-profile barrier 10 within the opposing surfaces 5, 6.

It is to be further understood that the frame 14 of the low-profile barrier 10 may be constructed so that at least one (or both) of the angles θ1, θ2 may be initially splayed (or angled) at approximately 90-degrees in an uninstalled configuration. That is, for example, the angle θ1 between the first upright frame member 24 and the gusset 31 may be originally angled at 90-degrees. In this example, only the second bias force produced by compressing the curvature θ3 in the lower support member 28 is relied on to provide the securing friction force between the upright frame members 24, 26 and the opposing surfaces 5, 6.

Furthermore, a portion of the lower support member 28 may be constructed to substantially take the shape of the bottom of the gusset 31 and the remainder of the lower support member 28 will include the predetermined curvature θ3. FIG. 1 illustrates this feature in detail. The lower surface 31*a* of the gusset 31 is securely fastened to an upper surface 28*m* up to an edge 31*b* on the gusset 31. Likewise, the lower surface 33*a* of the gusset 33 is securely fastened to an upper surface 28*n* up to an edge 33*b* on the gusset 33.

The lower support member 28 will take the flat shape of the lower surfaces 31*a*, 33*a* of the gussets 31, 33. As such, the predetermined curvature θ3 may be constructed in the lower support member 28 between the ends 31*b*, 33*b* of the gussets 31, 33 so that when the lower support member 28 is compressed as shown in FIG. 2, the entire lower surface of the lower support member lays flat against the lower surface 4.

Figure 3:
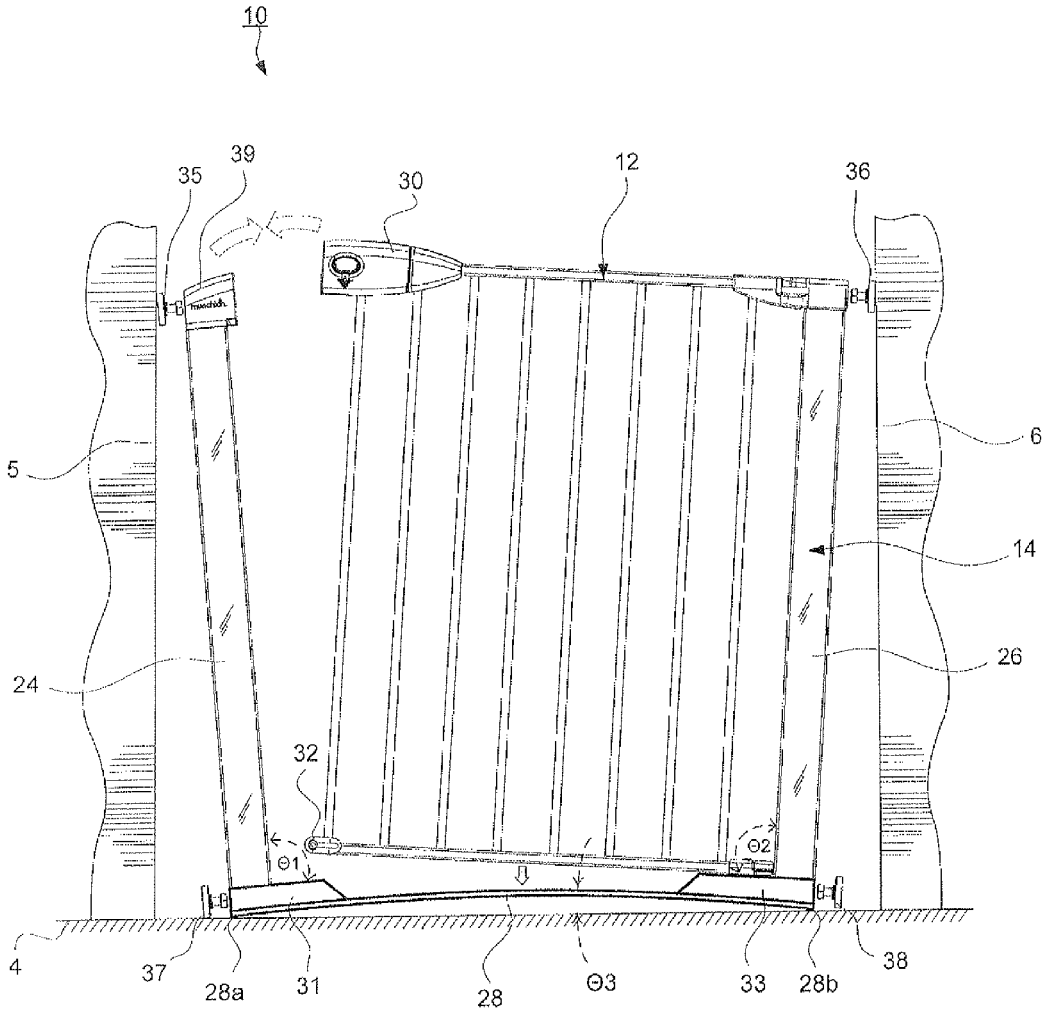
FIG. 3 shows the exemplary low-profile barrier assembly positioned and slightly compressed within a doorframe in accordance with aspects described herein.
Figure 4:
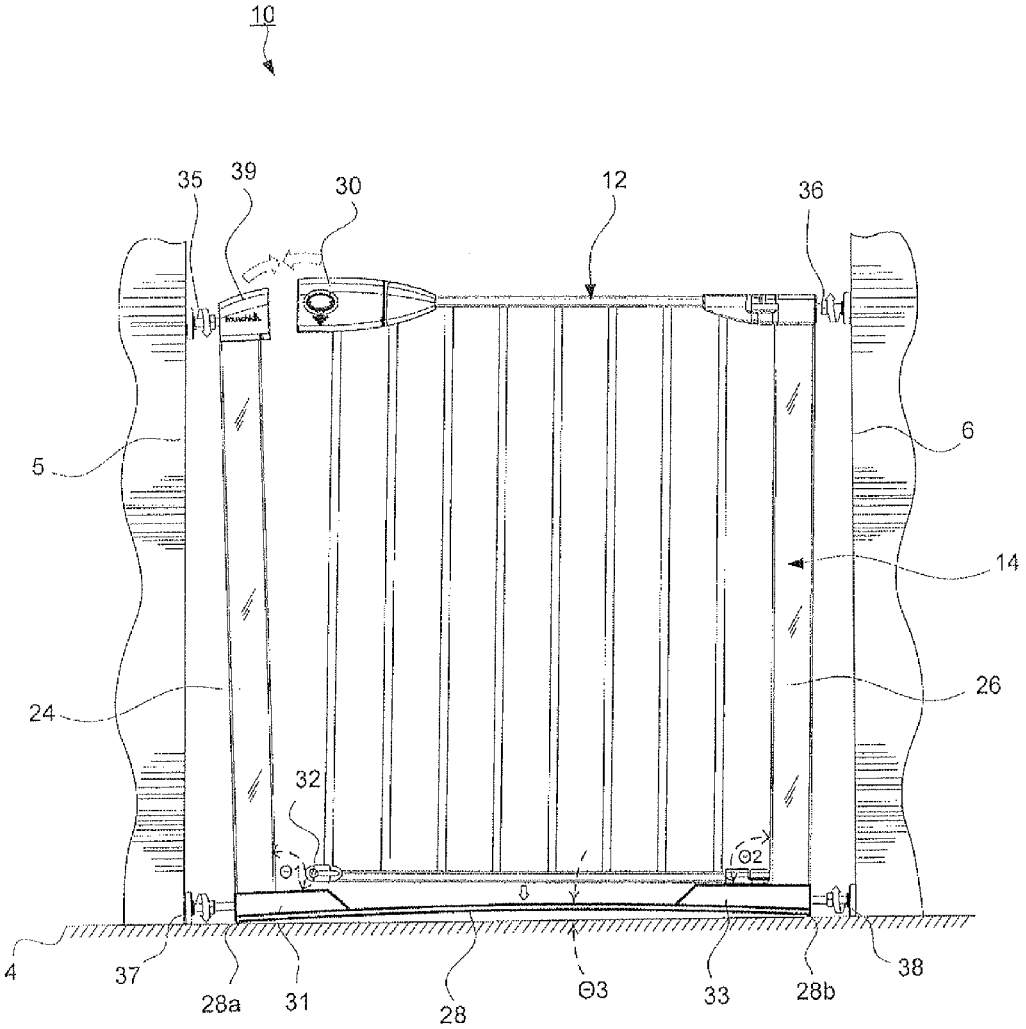
FIG. 4 illustrates the example low-profile barrier assembly being compressed within the doorframe in accordance with aspects described herein.

FIGS. 2 through 4 demonstrate an exemplary installation process for the low-profile barrier 10 in which the predetermined curvature θ3 in the lower cross member 28 is compressed flush against a lower surface 4, and the upright frame members 24, 26 are secured between opposing surfaces 5, 6.

In FIG. 3, the adjustable fasteners 35, 36, 37, 38 are inserted into various receiving plugs 44 (as shown in FIGS. 7A and 7B) in the low-profile barrier 10. The low-profile barrier 10 is placed between the opposing surfaces 5, 6, and the ends 28*a*, 28*b* of the lower cross member 28 are positioned adjacent to the lower surface 4.

It is to be understood that the opposing surfaces 5, 6 and lower surface 4 may be any one of a plurality of openings. For example, the opposing surfaces 5, 6 may be sides of a doorway, walls of a hallway, walls of railings of a stairwell and/or any other opening having substantially opposing surfaces that adjustable helical clamps 35, 36, 37, 38 can grab onto and apply a sturdy friction fit. Likewise, the lower surface 4 of the opening may be a hallway floor, a step on a staircase and/or any other suitable lower surface location where the low-profile barrier 10 may be installed. The low-profile barrier 10 is particularly convenient to install on a staircase, whereas conventional barriers system failed. The width of the low-profile barrier 10 assembly is sufficiently narrow, and can be conveniently installed with ease on a single step of a staircase in a low-profile manner so that a tripping danger is eliminated.

Referring back to FIG. 3, gradually, the adjustable fasteners 35, 36, 37, 38 are axially extended outward against the opposing surfaces 5, 6. As the upper adjustable fasteners 35 and 36 are extended outward against the opposing surfaces 5, 6, the upper ends of the upright frame members 24, 26 are pushed inward toward a vertical position. Likewise, the gussets 31, 33 are radially torqued downward and an axial length of the gussets approaches a substantially horizontal position. The axial length of the gussets 31, 33 is disposed along the length of the gussets 31, 33, and is substantially perpendicular to an axial length of the upright frame members 24, 26, respectively.

As increasing tension is applied by the resultant force of the adjustable fasteners 35, 36, the angles θ1, θ2 disposed between the upright frame members 24, 26 and gusset member 31, 33 are compressed toward a 90-degree angle so that the upright frame members are substantially aligned parallel to the opposing surfaces 5, 6. Likewise, the predetermined curvature θ3 gradually flattens out so that the lower cross member 28 moves toward a position where it lays flush against the lower surface 4.

FIG. 4 demonstrates a progressed installation configuration from FIG. 3 in which the adjustable fasteners 35, 36, 37, 38 are further axially extended outward against the opposing surfaces 5, 6. As upper adjustable fasteners 35 and 36 are further extended outward against the opposing surfaces 5, 6, the upper ends of the upright frame members 24, 26 are pushed further inward toward a vertical position. The gussets 31, 33 are also further torque to turn downward such that the axial length of the gussets approaches a substantially horizontal position and lies flush with the lower surface 4 fastened on top of the lower cross member 28.

As increasing tension is continually applied by the resultant force of the adjustable fasteners 35, 36, the angles θ1, θ2 disposed between the upright frame members 24, 26 and gusset member 31, 33 continues to compress each of the angles θ1, θ2 toward the 90-degree angle. Likewise, the predetermined curvature θ3 is further flattened out as the lower cross member 28 flush to the lower surface 4.

Finally, FIG. 2 and exploded FIG. 5 depict the low-profile barrier 10 fully compressed and secured within opposing surfaces 5, 6. When the low-profile barrier 10 is completely installed as shown, the lower cross member 28 lies substantially flush against the floor. In this closed position, the low-profile barrier 10 is sized to substantially block the passageway so that small children, animals and various objects cannot pass there through.

As shown, the upper adjustable fasteners 35 and 36 are extended outward against the opposing surfaces 5, 6 so to an operable position so that the handle member 30 is matingly aligned with the catch mechanism 39. In this position, the upright frame members 24, 26 are disposed in a substantially vertical orientation and are substantially parallel to the opposing surfaces 5, 6. The gussets 31, 33 are compressed downward such that the length of the gussets lies in a substantially horizontal orientation.

In this installed position, the angles θ1, θ2 disposed between the upright frame members 24, 26 and gusset member 31, 33 are substantially aligned at a 90-degree angle, and the predetermined curvature θ3 is substantially eliminated so that the lower frame member 28 lies completely flattened out and flush to the lower surface 4.

The angles θ1, θ2 and the curvature θ3 cooperate and are selected based on various factors. As shown in the FIGS. 1-7, angle θ1 is measured between the upright frame member 24 and gusset 31. Among various factors, the angle selected for θ1 may be based on the size, shape, length, weight and material properties of the upright frame member 24, the gusset 31, the lower support member 28 and the connections there between. Additional factors to consider are the fastening means between the upright frame member 24, the gusset 31 and the lower support member 28.

Angle θ2 is measured between the upright frame member 26 and gusset 33. Among various factors, the angle selected for θ2 may be based on the length, weight and material properties of the the barrier door 12, upright frame member 26, the gusset 33, the lower support member 28 and the connections there between. Additional factors to consider are the fastening means between the barrier door 20, the upright frame member 26, the gusset 33 and the lower support member 28.

The curvature θ3 is dependent on a variety of different factors. The predetermined curvature θ3 may be a radius of a circle, an arc, an ellipsoid or any other curve capable of operably being formed as an upward curve in the lower support member 28 so that when the low-profile barrier 10 is securely fastened in place (as shown in FIG. 2), the lower support member 28 lays flush with the lower surface 4. Although none shown, it is to be understood that the curvature may be formed in an inverted manner so that a downward curve is formed in the lower support member 28 to produce the spring bias.

The lower cross member 28 may employ a variety of different bending techniques to physically alter the shape of the lower cross member 28 with a predetermined curvature. Annealing, rolling dies, a mandrel, a press and/or table form, a bending machine and/or any other suitable type of commercially available bar bending process may be used.

Various processes for joining materials are commonly known and may be used to join the various component parts. Welding is one fabrication or sculptural process that can be employed to join the various material component parts. The properties of the weld quality of the welded joint may also be taken into consideration. Soldering, brazing, threaded fastening and/or any other typed of fastening may also be considered between the various components. Many different energy sources can be used for welding, including, but not limited to a gas flame, a arc, a laser, an electron beam, friction and ultrasound.

The materials used for the various components may be a metal, an alloy, a polymer, a composite and/or any suitable material capable of performing the features and attributes described by the low-profile barrier 10 of this subject disclosure. The material characteristics that may be considered may include, but not limited to: plasticity or restoring forces, rigidity, compression and tensile capacities, modulus of elasticity and deformation properties that may include but are not limited to: malleability, ductility, slip, creep, fatigue limits and/or other physical behaviors of a particular material used. It is to be understood that the various parameters of the component parts and alternative methods of fastening the low-profile barrier 10 may be varied without departing from the scope of this subject disclosure.

Figure 14:
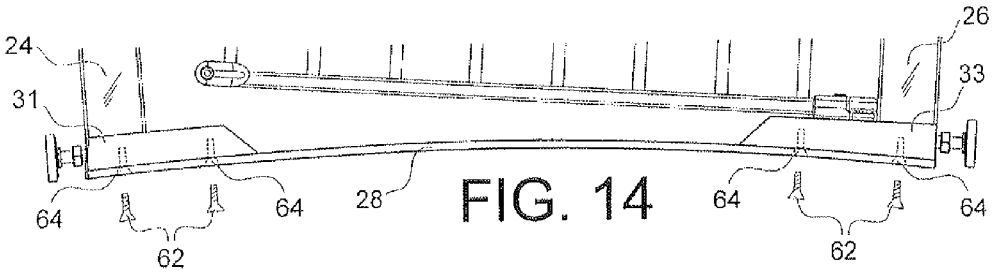
FIG. 14 illustrates various exemplary fasteners securing the lower cross member to the gussets according to the subject disclosure.
Figure 15:
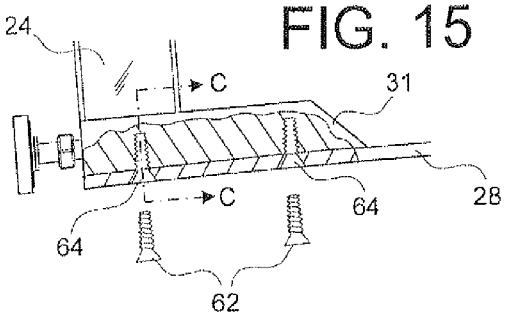
FIG. 15 depicts an exploded view of the fasteners securing the lower cross member to the gussets.

For example, FIGS. 14-21 illustrate various methods for securing the lower cross member 28 to the gussets 31, 33. In FIGS. 14 and 15, threaded recesses 64 may be disposed in the lower cross member 28 and in the gussets 31, 33 for receipt of various mating threaded fasteners 62 and/or retaining inserts 66 to be used in combination with the threaded fasteners 62.

Figure 16:
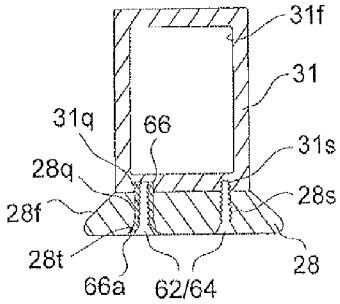
FIG. 16 shows a cross section view of the fasteners disposed in the lower cross member and the gussets.
Figure 17:
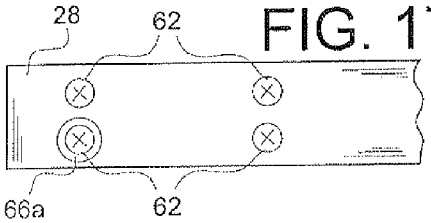
FIG. 17 illustrates a bottom view of the fasteners disposed in the lower cross member.
Figure 18:
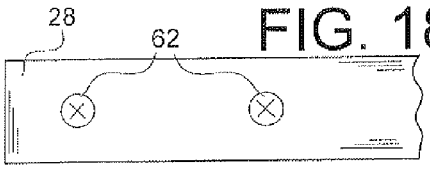
FIG. 18 depicts another bottom view arrangement for the fasteners disposed in the lower cross member.
Figure 19:
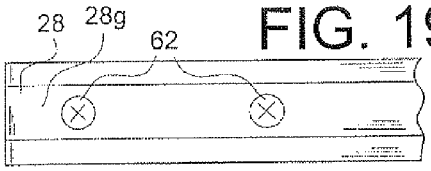
FIG. 19 shows another bottom view of the fasteners disposed in the bar disposed within the lower cross member.

FIG. 16 depicts a cross section view of the beveled **28*f* lower cross member 28 and the gusset 31 about cross section line C-C shown in FIG. 15. FIG. 17 shows a bottom view of the lower cross member 28. The threaded fasteners 62 may be arranged in a pattern where a pair of fasteners 62 is disposed in a lateral side-by-side arrangement. In the alternative, the securing pattern may take any pattern arrangement, such as shown in FIG. 18 or 19**. Any other suitable securing pattern configuration is possible in accordance with this subject disclosure.

In FIG. 16, two exemplary fastening mechanisms are shown in cross section to secure the lower support member 28 to the gusset 31. In one configuration, the lower cross member 28 may be provided with a first aperture **28*q* having a flange 28*t* disposed therein. Likewise, the gusset 31 may include a mating aperture 31*q* that may be partially, or completely, extended through the interior gusset wall 31*f*. A first threaded fastener 62 is disposed within the insert 66. The threaded insert 66 may have a flange 66*a* adapted to retain the insert 66 in position when it is located within the flange 28*t* of the lower cross member 28. Although shown in the lower cross member 28, the flange may be disposed anywhere on the lower cross member 28, the gussets 31, 33 or the upright frame members 24, 26 in order to position the insert 66. When the threaded fastener 66 is tightened into the threaded insert 66*a*, the threaded insert 66** slightly expands, rendering a secure fastening.

Figure 20:
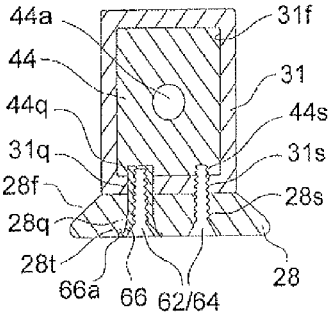
FIG. 20 illustrates another cross section view of the fasteners disposed through the lower cross member, a gusset and a plug.
Figure 21:
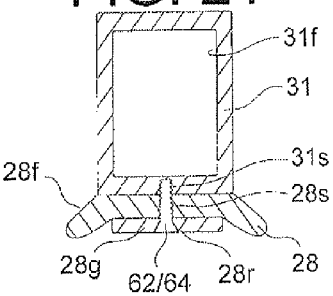
FIG. 21 depicts another cross section view of the fasteners disposed through a bar, the lower cross member and the gusset.

In alternative configurations shown in FIGS. 20-21, the threaded fastener 62 may be threaded right into various threaded recesses **28*r*, 28*s*, 31*s*, 44*s* disposed in the bar 28*g*, lower cross member 28, the gusset 31 and the plug 44**, respectively.

The threaded fastener 62 and/or insert 66 may be disposed within the lower cross member 28 and gusset 31 so that they do not extend beyond an interior wall **31*f* of the gusset 31 as shown in FIG. 16. In an alternative, the threaded fastener 62 and/or insert 66 may be disposed within the lower cross member 28 and the gusset 31 so that they project beyond the interior gusset wall 31*f* and into a plug 44, as shown in FIG. 20. As such, the plug 44 may be adapted to receive the fasteners 62, and/or the inserts 66 therein, in addition to the adjustable fasteners 35, 36, 37, 38 within a receiving aperture 44*a***.

Although shown as threaded fasteners 62 being received by recesses 64, or inserts 66, it is to be understood that any suitable arrangement and/or type of securing fastener may be used, such as but not limited to: screw thread coils, blind rivets, blind rivet nuts, bolts, specialized threaded inserts, internal thread locking systems, non-threaded fasteners or the like in accordance with the subject disclosure. Likewise, it is also understood that the lower cross member 28 may be secured directly to the upright frame members 24, 26 in a manner described above and/or any other suitable manner in accordance with the subject disclosure.

Figure 12:
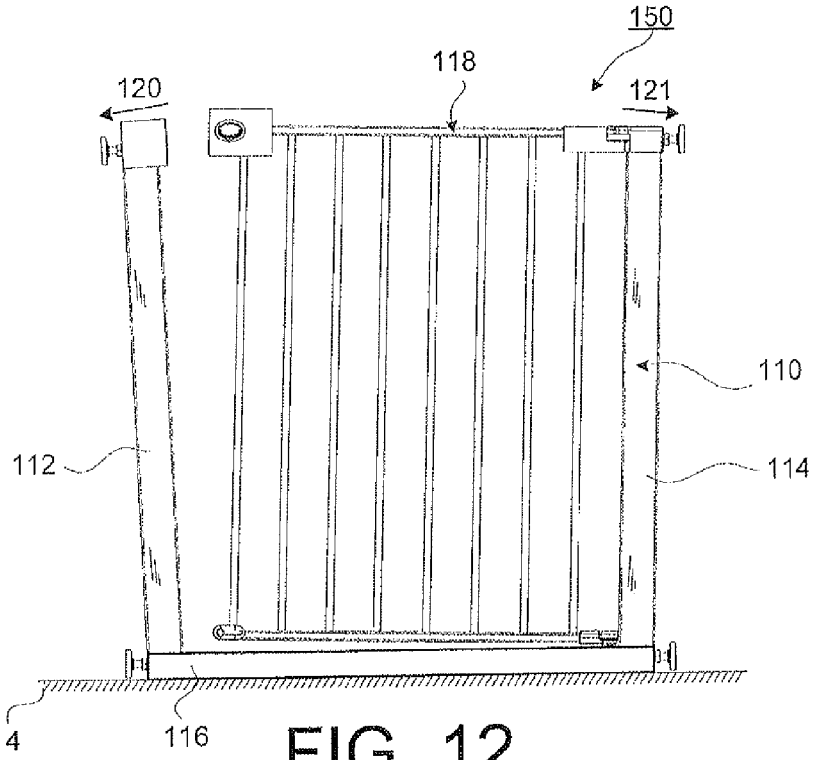
FIG. 12 depicts a conventional safety gate having a large rigid lower cross member.
Figure 13:
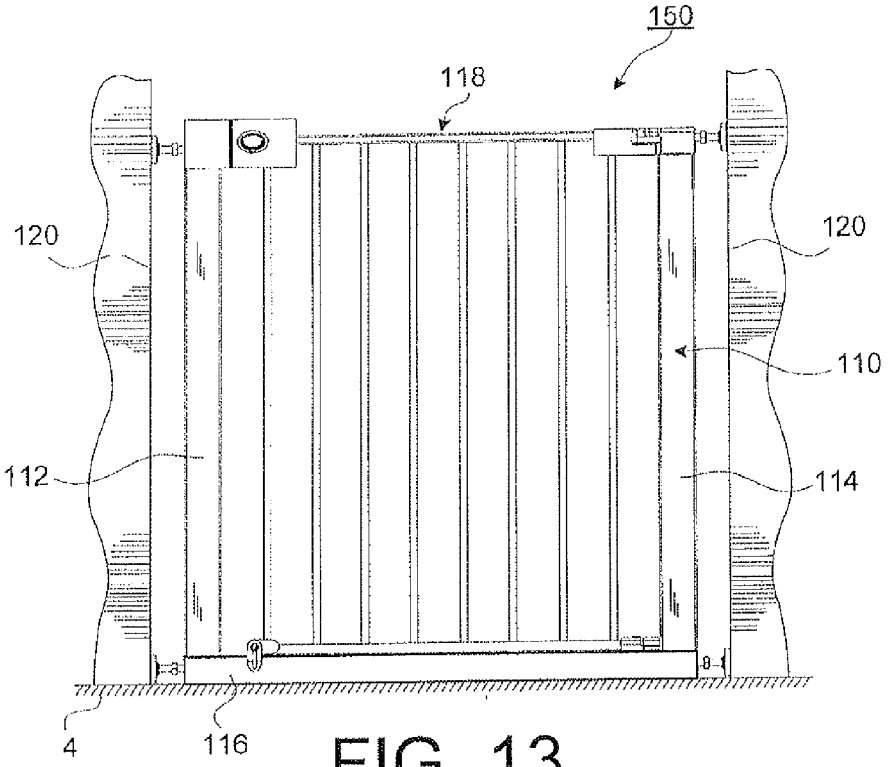
FIG. 13 shows the conventional safety gate installed in a doorway.

As mentioned previously, the low-profile barrier 10 is ideal for reducing the trip hazard commonly experienced with other conventional safety gates as described in FIGS. 12-13 where the conventional height of the lower cross member 116 extends upward in an obtrusive manner typically in a range between 1⅛ inches to 2 inches. On the contrary, the lower cross member 28 of the instant disclosure is a thin low-profile member lying flush against the floor at a height in a range of between approximately ⅜ of an inch to 1 inch, and preferably between ½ to ¾ of an inch. This reduction in height is dramatic and remarkably overcomes the dangerous trip hazard that is replete in conventional gate systems.

Figure 11:
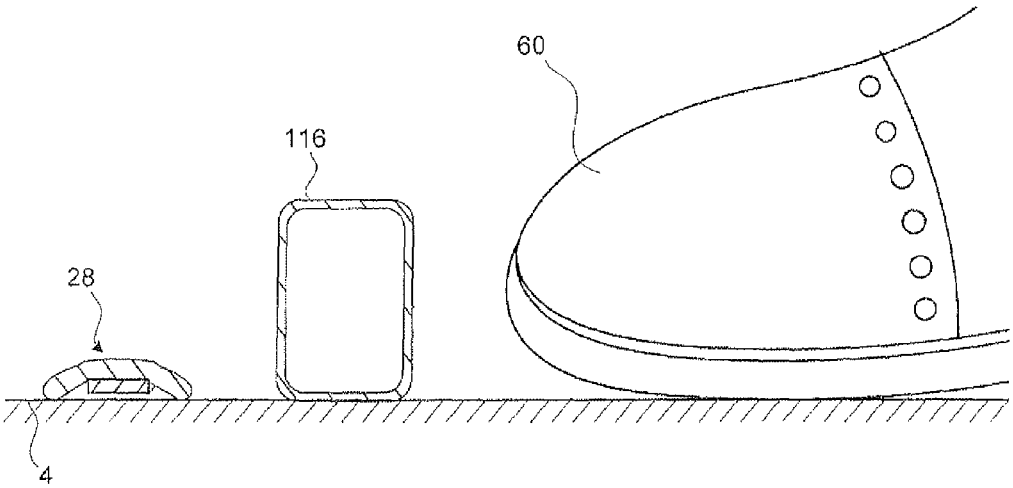
FIG. 11 is an exemplary illustration of the height of the lower cross member of the low-profile barrier assembly versus a lower frame cross member of a conventional gate assembly.

By way of example, FIG. 11 illustrates a height difference of the lower cross member 28 of the low-profile barrier 10 assembly versus a lower frame cross member 116 of a conventional gate assembly. Since the protruding height of the lower cross member 28 of the low-profile barrier 10 is so low, the trip hazard by the foot 60 of a passerby is dramatically reduced. In addition to providing a reduced obstruction in a passageway, the low-profile barrier 10 is ideal for installation across at least one step on a staircase.

FIGS. 5, 6A, 6B, 7A and 7B further illustrate the lower cross member 28 as exemplary lower cross members 128, 228. FIG. 6A shows an exemplary cross section view of the lower cross member 128 about section lines A-A in FIG. 5. The lower cross member 128 is constructed from a substantially flat outer bar 28*c* having an upper surface 28*d* that is convex and a similar lower surface 28*e* where both are upwardly curved. The upper surface 28*d* of the lower cross member 128 may be shaped to include beveled edges 28*f*. The flat bar 28*c* may be reinforced with another bar 28*g* made of a similar or different material.

The bar 28*g* may be connected to the flat convex bar 28*c* to provide the curvature in the lower cross member 128 prior to installation. For example, the material properties of the bar 28*g* may be different from the material properties of the flat convex bar 28*c* so that together when treated generate the curvature in the lower cross member 128.

The bar 28*g* may be fastened to the flat bar 28*c* in a variety of different ways, such as by welding as mentioned above and/or any other method for fastening the two pieces to each other with a sufficiently strong bond that prevents separation thereof. FIG. 7A further illustrates the threshold lower cross member 128 of FIG. 6A and the upright frame member 26 about section B-B in FIG. 5.

Alternatively, FIG. 6B shows another exemplary cross section view of a lower cross member 228 about section lines A-A in FIG. 5. The lower cross member 128 is constructed from a flat bar 28*h* having an upper surface 28*i* that is convex, or curved downward having a lower flat surface 28*j*. The upper surface 28*i* of the lower cross member 228 may also be shaped to include beveled edges 28*f*. The flat bar 28*h* may be shaped through various processes to provide the curvature in the lower cross member 228 prior to installation. FIG. 7B illustrates the threshold member 228 of FIG. 6A and the upright frame member 26 about section B-B in FIG. 5.

When the low-profile barrier 10 is installed in a passageway, the lower cross members 28, 128, 228 and the beveled edges 28*d* resemble a low-profile threshold that substantially eliminates the tripping hazard.

Figure 8:
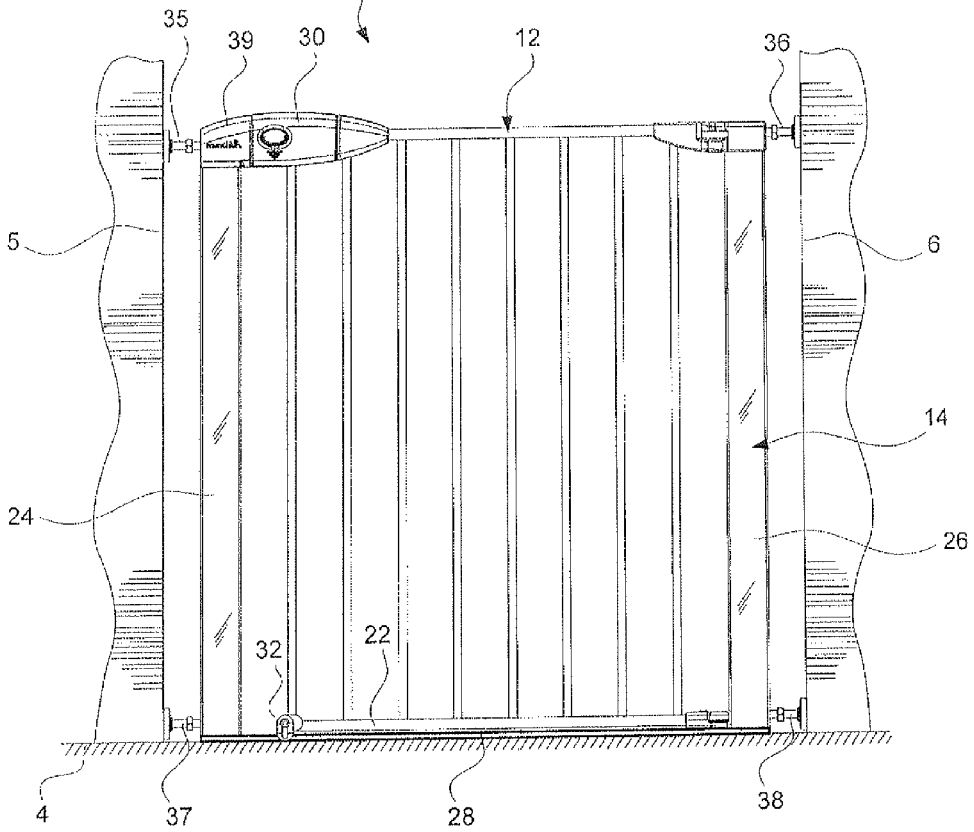
FIG. 8 shows another example of a low-profile barrier assembly fully compressed and secured within the doorframe in accordance with aspects described herein.
Figure 9:
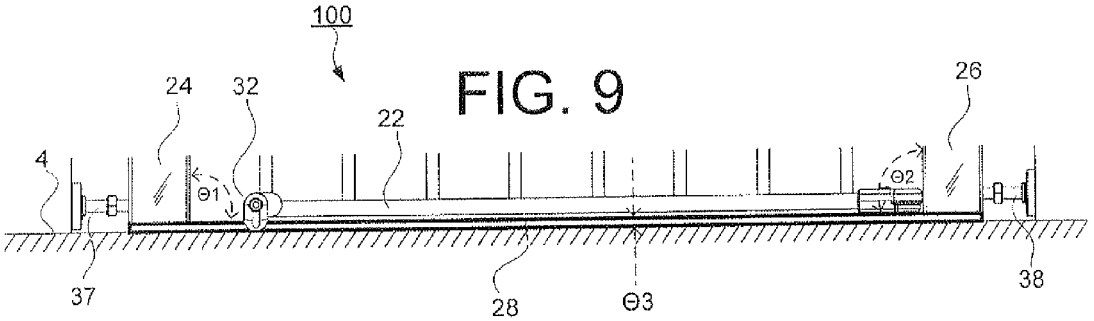
FIG. 9 illustrates an exploded view of the other example of the low-profile barrier assembly fully compressed and secured within the doorframe in accordance with aspects described herein.

FIGS. 8 and 9 show another exemplary low-profile barrier assembly 100 fully compressed and secured within opposing surfaces 5, 6 according to the subject disclosure. In this example, gussets are not attached between the lower cross member 28 and the upright frame members 24, 26, respectively. The exemplary low-profile barrier 100 incorporates all of the features and functionality of the low-profile barrier 10 described herein.

Similarly, during installation, the low-profile barrier 100 is fully compressed and secured within opposing surfaces 5, 6 and the lower cross member 28 lies substantially flush against the lower surface 4. As shown, the upper adjustable fasteners 35 and 36 are extended outward against the opposing surfaces 5, 6 so that the handle member 30 is matingly aligned with the catch mechanism 39. In this position, the upright frame members 24, 26 are disposed in a substantially vertical orientation and substantially parallel to the opposing surfaces 5, 6. The angles θ1, θ2 disposed between the upright frame members 24, 26 and lower cross member 28 are substantially aligned at a 90-degree angle, and the predetermined curvature θ3 is eliminated such that the lower cross member 28 lies completely flattened out and flush to the lower surface 4.

Figure 10:
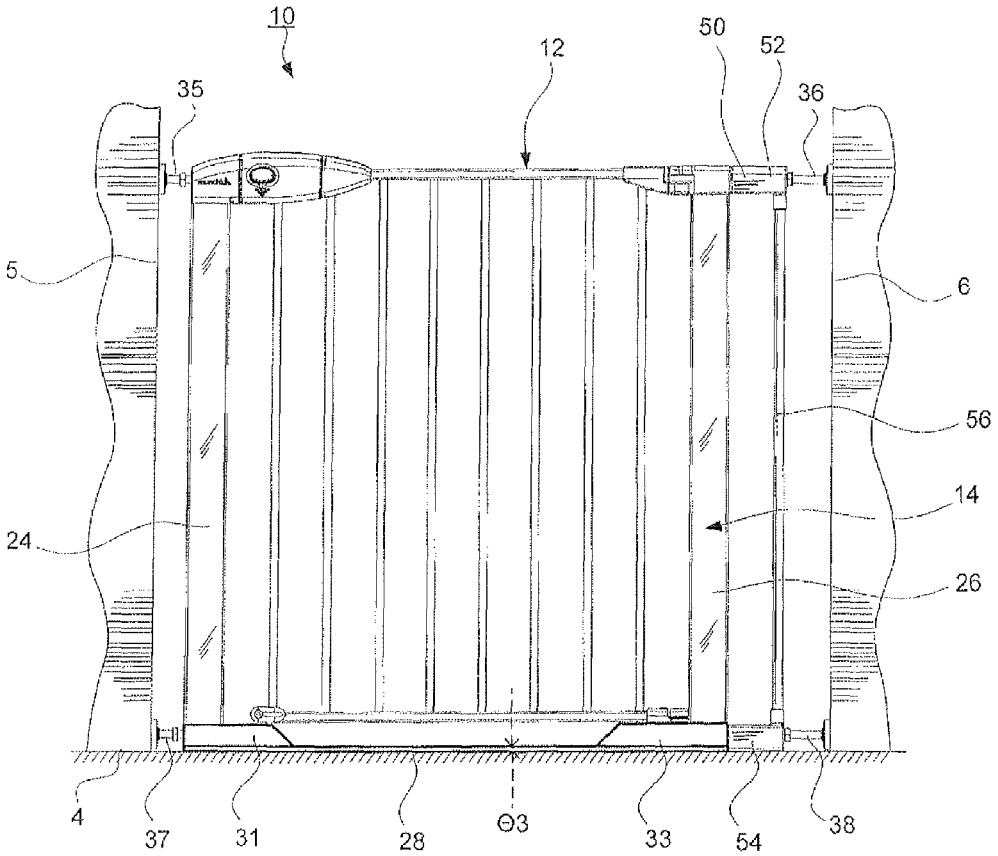
FIG. 10 depicts the low-profile barrier assembly including an extension member fully compressed and secured within the doorframe in accordance with aspects described herein.

The low-profile barrier 10 can be adapted for various size passageways using conventional components. For example, FIG. 10 depicts the low-profile barrier 10 including a frame extension 50 in the fully compressed and secured position within the opposing surfaces 5, 6. The frame extension 50 includes an upper extension member 52 and a lower extension member 54 connected by an extension bar 56.

Various size frame extensions may be provided based on the length between the opposing surfaces 5, 6 to be blocked by the low-profile barrier 10. The adjustable fasteners 36 and 38 are attached to the upper and lower extension members 52, 54 respectively. As mentioned above in more detail, each of the adjustable fasteners 35, 36, 37, 38 are axially extended outward against the opposing surfaces 5, 6. The outward extension allows proper alignment of the upright frame members 24, 26, as well as to compress the predetermined curvature θ3 and secure the lower cross member 28 of the low-profile barrier 10 flush to the floor within the passageway.

As employed in this specification and annexed drawings, the term "or" is intended to mean an inclusive "or" rather than an exclusive "or." Moreover, articles "a" and "an" as used in the subject specification and annexed drawings should generally be construed to mean "one or more" unless specified otherwise or clear from context to be directed to a singular form.

What has been described above includes examples of a low-profile assembly and method of installation that provide advantages of the subject disclosure. It is, of course, not possible to describe every conceivable combination of components or methodologies for purposes of describing the subject disclosure, but one of ordinary skill in the art may recognize that many further combinations and permutations of the claimed subject matter are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim.

What is claimed is:

1. A method of installing a barrier having a frame with a pair of upwardly extending arms connected to a lower cross member having a curvature in an uninstalled configuration, and a barrier door connected to one of the upwardly extending arms, comprising:

positioning the barrier between opposing surfaces and above a lower surface; and extending adjustable fasteners connected to the frame outward to compress:

the upwardly extending arms inward; and the curvature in the lower cross member flat such that the lower cross member lays substantially flush against the lower surface.

2. The method recited in claim 1, where in the positioning step, ends of the lower cross member having the curvature are positioned adjacent to the floor.

3. The method recited in claim 1, wherein the barrier further comprises a pair of gussets disposed between the upwardly extending arms and the lower cross member.

4. The method recited in claim 3, where in the extending step further compresses an axial length of the gussets into a substantially horizontal position.

5. The method recited in claim 1, where in the extending step further compresses the upwardly extending arms from a first angle of greater than 90 degrees to a second angle of approximately 90 degrees with respect to the lower cross member.

6. The method recited in claim 1, where in the extending step further comprises overcoming a spring biased force inert in the curvature in the lower cross member.

7. The method recited in claim 1, wherein the adjustable fasteners comprise:

upper adjustable fasteners connected to the upwardly extending arms that compress the upwardly extending arms inward and the curvature in the lower cross member substantially flush against the lower surface; and lower adjustable fasteners connected to the frame that further secure the lower portion of the barrier to the opposing surfaces.

8. The method recited in claim 1, where in the extending step the adjustable fasteners are adjusted outward in an axial helical motion.

9. The method recited in claim 1, where in the extending step is complete when a handle and a retaining member on the barrier are operably aligned.

10. The method recited in claim 9, wherein the handle is mounted to the barrier door and mates with the retaining member disposed on at least one of the upwardly extending arms.

11. The method recited in claim 1, wherein the lower cross member is a thin low-profile bar with a beveled upper surface.

12. The method recited in claim 1, wherein the barrier door is pivotally attached to at least one of the upwardly extending arms by an upper and lower hinge that pivots about a pivot axis.

13. A method of installing a barrier having a frame with a pair of upwardly extending arms connected to a lower cross member having an upper member surface and a lower member surface, and a barrier door connected to one of the upwardly extending arms, wherein both the upper and lower member surfaces of the lower cross member have a predetermined curvature in an uninstalled configuration that extends along a longitudinal axis passing through the lower cross member, comprising:

positioning the barrier between opposing walls and above a lower floor; and extending adjustable fasteners connected to the frame outward to compress:

the upwardly extending arms inward; and the curvature in the upper and lower member surfaces flat such that the lower cross member lays substantially parallel to the lower floor.

14. The method recited in claim 13, where in the extending step further comprises overcoming a spring biased force inert in the curvature in the lower cross member.

15. A method of using a barrier having a frame with a pair of upright frame members connected to a lower cross member with a longitudinal axis running substantially in the direction of a greatest dimension of the lower cross member, the lower cross member having an upper member surface and a lower member surface having a curvature that extends substantially along the longitudinal axis such that the lower cross member is non-parallel with the longitudinal axis in an uninstalled configuration, and a barrier door connected to one of the upwardly extending arms, comprising:

positioning the barrier between opposing surfaces and above a lower surface; and compressing the upright frame members inward to overcome a spring biased force inert in the curvature in the lower cross member such that the lower cross member lays substantially flush against the lower surface.

16. The method recited in claim 15, further comprising the steps:

opening the barrier door to permit access through the barrier; and closing the barrier door to prevent access through the barrier.

17. The method recited in claim 15, where in the closing step includes mating a handle mounted to the barrier to a catch mechanism disposed on at least one of the upright frame members to lock the barrier into place.

18. The method recited in claim 15, wherein the barrier door is pivotally attached to at least one of the upwardly extending arms by an upper and lower hinge.

19. The method recited in claim 15, where in the compressing step includes extending adjustable fasteners connected to the frame outward.

20. The method recited in claim 15, where in the uninstalled configuration, the lower cross member has an upper member surface and a lower member surface both having the curvature and extending along a longitudinal axis passing through the lower cross member.

* * * * *